US009255384B2

(12) United States Patent
Hiraoka et al.

(10) Patent No.: US 9,255,384 B2
(45) Date of Patent: Feb. 9, 2016

(54) CONSTRUCTION MACHINE WITH PILOT HOSES

(71) Applicant: KOBELCO CONSTRUCTION MACHINERY CO., LTD., Hiroshima-shi (JP)

(72) Inventors: Yukio Hiraoka, Hiroshima (JP); Keiji Yamamoto, Hiroshima (JP); Masanori Sakatani, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 14/511,489

(22) Filed: Oct. 10, 2014

(65) Prior Publication Data

US 2015/0115657 A1 Apr. 30, 2015

(30) Foreign Application Priority Data

Oct. 30, 2013 (JP) ..... 2013-224971

(51) Int. Cl.
*E02F 9/16* (2006.01)
*E02F 9/22* (2006.01)
*E02F 3/32* (2006.01)

(52) U.S. Cl.
CPC ..... *E02F 9/16* (2013.01); *E02F 9/2275* (2013.01); *E02F 3/325* (2013.01)

(58) Field of Classification Search
CPC ..... E02F 9/16; E02F 9/2271
USPC ..... 296/190.08, 190.01, 208
See application file for complete search history.

(56) References Cited

U.S. PATENT DOCUMENTS 8,632,122 B2 * 1/2014 Kimura ..... B62D 33/0617 296/190.01
2008/0005937 A1 1/2008 Nakayoshi et al.
2013/0025170 A1 * 1/2013 Caillieret ..... E02F 9/08 37/425

(Continued)

FOREIGN PATENT DOCUMENTS

DE 716021 C 1/1942
JP 2-132759 U 11/1990

(Continued)

OTHER PUBLICATIONS

Extended European Search Report issued Mar. 5, 2015 in Patent Application No. 14189001.2.

(Continued)

*Primary Examiner* — Jason S Morrow
(74) *Attorney, Agent, or Firm* — Oblon, McClelland, Maier & Neustadt, L.L.P.

(57) ABSTRACT

Provided is a construction machine where a pilot hose is easily routed. The construction machine includes a seat stand, an operator's seat provided on the seat stand, a remote control valve provided just above a front end of the seat stand at least one of right and left sides of the operator's seat; a hydraulic valve; and a pilot hose interconnecting the remote control valve and the hydraulic valve. The seat stand has an upper surface including a specific surface located beneath the remote control valve and a reference surface on which the operator's seat is installed. A step is provided between the specific surface and the reference surface to make the specific surface be lower than the reference surface, thus enlarging a space for routing the pilot hose beneath the remote control valve.

4 Claims, 4 Drawing Sheets

(56) References Cited

U.S. PATENT DOCUMENTS

| | | | | |
|---|---|---|---|---|
| 2013/0067901 | A1* | 3/2013 | Masuda | E02F 9/16 60/484 |
| 2015/0115659 | A1* | 4/2015 | Kurushima | E02F 3/325 296/190.08 |
| 2015/0115660 | A1* | 4/2015 | Sasaki | E02F 3/325 296/190.08 |

FOREIGN PATENT DOCUMENTS

| | | | |
|---|---|---|---|
| JP | 2001-107390 | A | 4/2001 |
| JP | 2002-227249 | | 8/2002 |
| JP | 2006-77544 | A | 3/2006 |
| JP | 2007-303213 | A | 11/2007 |
| JP | 2008-31817 | | 2/2008 |
| JP | 2009-263985 | A | 11/2009 |
| JP | 2010-024715 | A | 2/2010 |
| JP | 2010-265582 | A | 11/2010 |

OTHER PUBLICATIONS

Japanese Office Action mailed Aug. 18, 2015, in Application No. 2013-224971.

* cited by examiner

CONSTRUCTION MACHINE WITH PILOT HOSES

BACKGROUND OF THE INVENTION

1. Field of the Invention

The present invention relates to a construction machine such as a hydraulic excavator, more particularly to a construction machine including a remote control valve provided beside an operator's seat, a hydraulic valve configured to be operated by the remote control valve, and a pilot hose interconnecting the remote control valve and the hydraulic valve.

2. Description of the Background Art

The background art of the present invention will be described by taking a small-size hydraulic excavator shown in FIG. 6, as an example.

This hydraulic excavator comprises a crawler-type lower travelling body 1, an upper slewing body 2 mounted on the lower traveling body 1 in such a manner as to be slewable about an axis X perpendicular to a ground surface, and a work attachment AT attached to a front portion of the upper slewing body 2. The work attachment AT includes a boom 3, an arm 4, a bucket 5, and respective hydraulic actuators for actuating the boom 3, the arm 4 and the bucket 5, namely, a boom cylinder 6, an arm cylinder 7 and a bucket cylinder 8.

The upper slewing body 2 includes an upper frame 9, on which a seat stand 10, an operator's seat 11 provided on the seat stand 10, a canopy 12 covering the operator's seat 11 from above, various manipulation devices, an engine, and engine-related devices are mounted. Other than this canopy type, there is also a type in which a cabin is provided in place of the canopy 12, and the seat stand 10 and the operator's seat 11 are provided inside the cabin, namely, a cabin type.

As shown in FIG. 7, the upper frame 9 includes a bottom plate 13, and a floor plate 14 disposed above the bottom plate 13 with a vertical interval. There is formed an underfloor space S in an underfloor region of a front and left portion of the upper frame 9, that is, between the bottom plate 13 and the floor plate 14. In the underfloor space S is installed a multiple control valve unit 15. The control valve unit 15 is an assembly of a plurality of hydraulic-pilot-controlled control valves (see JP 2008-31817 A and JP 2002-227249 A). The terms "front (forward)", "rear (rearward)", "right (rightward)" and "left (leftward)" mean directions on the basis of an operator seated in the operator's seat 11.

The control valve unit 15 is attached, for example, onto the bottom plate 13. On the other hand, there are provided a plurality of remote control valves 16 above the seat stand 10. The plurality of control valves included in the control valve unit 15 are operated by respective manipulations applied to the remote control valves 16.

Rearward of the underfloor space S stands upright a partition wall 17. The partition wall 17 defines an engine room 18 beneath the operator's seat 11 and the seat stand 10 supporting the operator's seat 11.

The plurality of remote control valves 16 are distributed on right and left sides of the operator's seat 11 in a front end region of an upper surface of the seat stand 10, and the remote control valves 16 and the control valves of the control valve unit 15 are interconnected through a plurality of pilot hoses H.

As regards routing of the pilot hoses H, particularly, routing of the pilot hoses H which interconnect the remote control valves 16 located on a side opposite to an entrance way for the operator's seat 11 (in the example shown in FIG. 7, the right remote control valve 16: this remote control valve 16 will hereinafter be referred to as "inward remote control valve") and the control valve unit 15 installed in the underfloor space S as mentioned above, there is the following problem. The position of the inward remote control valve 16 is set to the position for the easiest manipulation by a seated operator, with respect to a height direction, a front-rear direction and a right-left directions, and the space between a hose connection port in a lower surface of the inward remote control valve 16 located at the set position and the upper surface of the seat stand 10 is defined as a routing space: this routing space can have only a small height dimension as shown in FIG. 7, which requires the pilot hoses H to be bent with a great curvature within the routing space when they are routed. The routing with such large-curvature bending requires a complicated joint structure, thus involving increased component cost and deteriorated production efficiency due to an increase in workload in an assembling line.

SUMMARY OF THE INVENTION

It is an object of the present invention to provide a construction machine including a hydraulic valve such as a control valve, a remote control valve, and a pilot hose interconnecting the hydraulic valve and the remote control valve, the construction machine allowing the pilot hose to be easily routed with a simple structure.

Provided by the present invention is a construction machine which comprises: a lower travelling body; an upper slewing body including an upper frame and slewably mounted on the lower travelling body, the upper frame having a bottom plate and a floor plate provided above the bottom plate with a vertical interval; a seat stand located rearward of the floor plate and above the bottom plate of the upper frame; an operator's seat provided on the seat stand; a remote control valve provided just above a region of a front end portion of the seat stand, the region located at at least one of right and left sides of the operator's seat; a hydraulic valve configured to be operated by the remote control valve; and a pilot hose interconnecting the remote control valve and the hydraulic valve. The seat stand has an upper surface which includes a specific surface located beneath the remote control valve and a reference surface on which the operator's seat is provided, the upper surface of the seat stand being provided with a step between the specific surface and the reference surface so as to make the specific surface be lower than the reference surface and thus vertically enlarge routing space for routing the pilot hose beneath the remote control valve by the step.

DESCRIPTION OF EMBODIMENTS

There will be described embodiments according to the invention with reference to the drawings.

Figure 6:
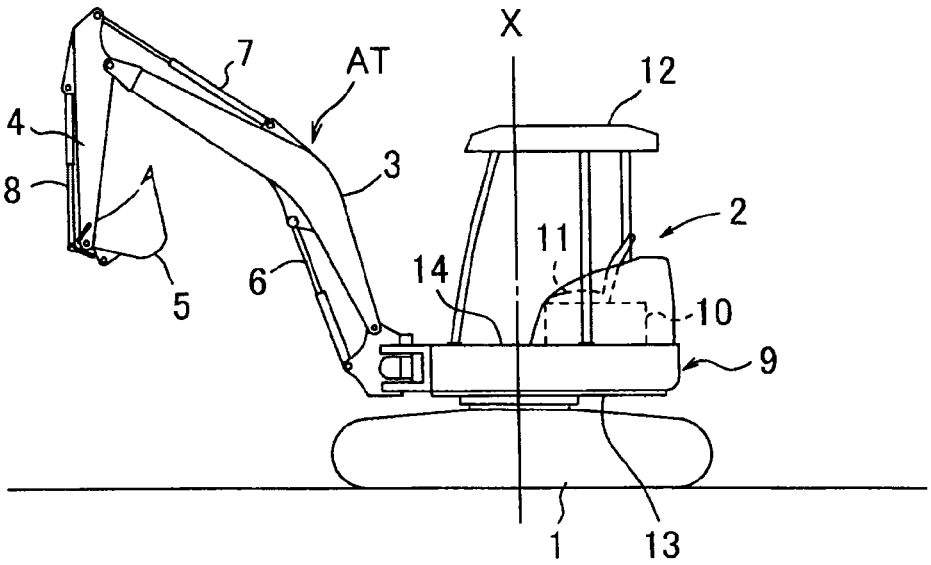
FIG. 6 Prior Art
FIG. 6 is a schematic side view of a small-size excavator as one example of a construction machine to which the present invention is applicable.

The embodiment described below is one example in which the present invention is applied to a small-size excavator shown in FIG. 6. Specifically, the excavator according to the embodiment comprises a crawler-type lower travelling body 1, an upper slewing body 2 mounted on the lower travelling body 1 in such a manner as to be slewable about an axis X perpendicular to a ground surface, and a work attachment AT attached to a frond end of the upper slewing body 2. The work attachment AT includes a boom 3, an arm 4, a bucket 5, and respective hydraulic actuators for actuating the boom 3, the arm 4 and the bucket 5, namely, a boom cylinder 6, an arm cylinder 7 and a bucket cylinder 8.

The upper slewing body 2 includes an upper frame 19, on which a seat stand 20, an operator's seat 21 provided on the seat stand 20, various manipulation devices, an engine, and engine-related devices are mounted.

Figure 1:
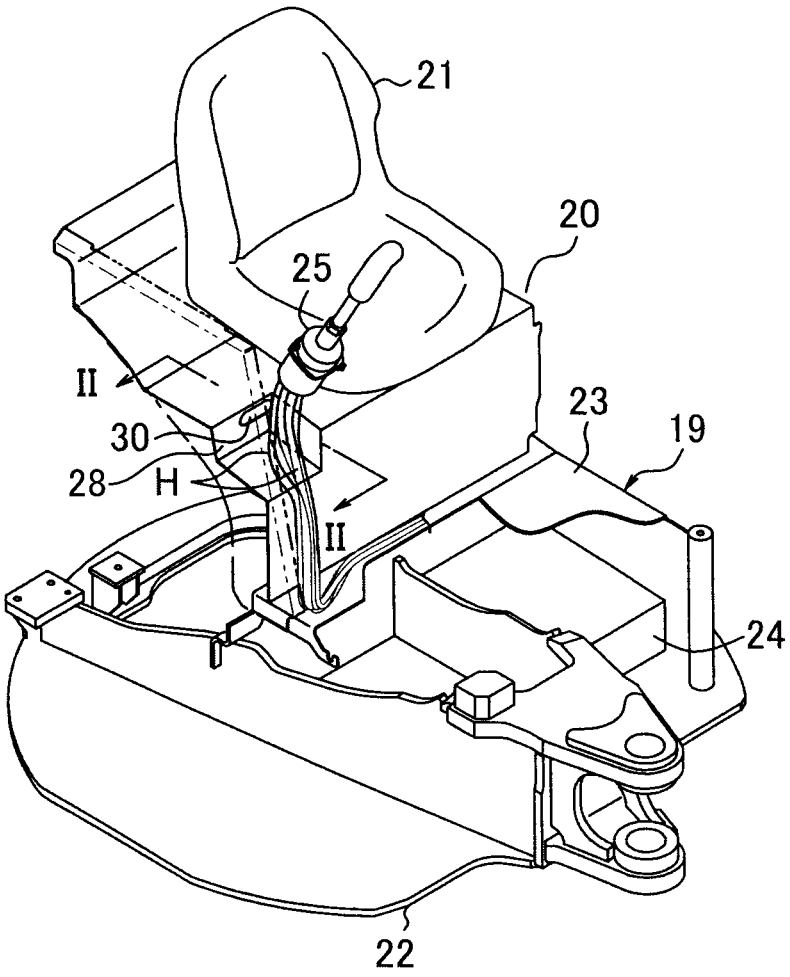
FIG. 1 is a fragmentary perspective view showing an important part of a small-size excavator according to one embodiment of the present invention.

As shown in FIG. 1, the upper frame 19 includes a bottom plate 22 and a floor plate 23 disposed above the bottom plate 22 with a vertical interval. There is formed an underfloor space S in an underfloor region of a front and left portion of the upper frame 19, that is, between the bottom plate 22 and the floor plate 23. In the underfloor space S is installed a multiple control valve unit 24. The control valve unit 24 is an assembly of a plurality of hydraulic-pilot-controlled control valves.

The control valve unit 24 is attached onto the bottom plate 22. On the seat stand 20, there are provided a plurality of remote control valves 25, by respective manipulation applied to which the control valves included in the control valve unit 24 are operated.

Rearward of the underfloor space S, there stands upright a partition wall 26. The partition wall 26 defines an engine room 27 beneath the operator's seat 21 and the seat stand 20 supporting the operator's seat 21.

The plurality of remote control valves 25 are distributed at right and left sides of the operator's seat 21 in a region just above a front end region of an upper surface of the seat stand 20, the remote control valves 25 and the control valves of the control valve unit 24 being interconnected through respective pilot hoses H.

According to this embodiment, for routing of the pilot hoses H which connect the control valve unit 24 and the remote control valves 25 located on a side opposite to an entrance way, namely, inward remote control valves (that is, the right remote control valve in the embodiment shown in FIG. 1), there is given the following structure.

The upper surface of the front end region of the seat stand 20 is provided with a step, which makes a specific surface 20*a* of the upper surface of the seat stand 20, the specific surface 20*a* being located beneath the inward remote control valve 25 (that is, a front right end region of the upper surface of the seat stand 20 in the embodiment shown in FIG. 1), be lower than a reference surface 20*b* of the upper surface, that is, a surface on which the operator's seat 21 is installed. A step wall 28 approximately vertically standing is interposed between the specific surface 20*a* and a surface rearward thereof.

Figure 3:
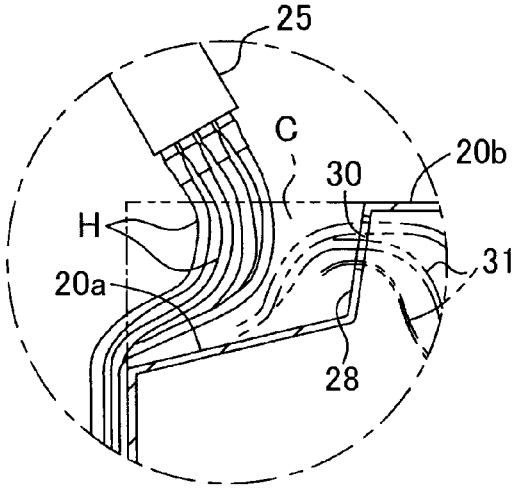
FIG. 3 is an enlarged view of a part of FIG. 2.

The step enlarges a space located beneath the inward remote control valve 25, namely, a routing spaces C for routing the pilot hoses H as shown in FIG. 3, by a vertical size of the step. The pilot hose H connected to a hose connection port provided in a lower surface of the inward remote control valve 25 is arranged through the routing space C and along a front surface of the seat stand 20, while being connected to the control valve unit 24 in a region of the underfloor space S located forward of the partition wall 26. The step enables the routing space C with necessary and sufficient depth and width dimensions for routing the pilot hoses H in the above course to be formed. The floor plate 23 is provided with a pilot hose inlet hole 29 at a suitable position, allowing the pilot hoses H to be introduced into the underfloor space S through the pilot hose inlet hole 29 from above.

Figure 2:
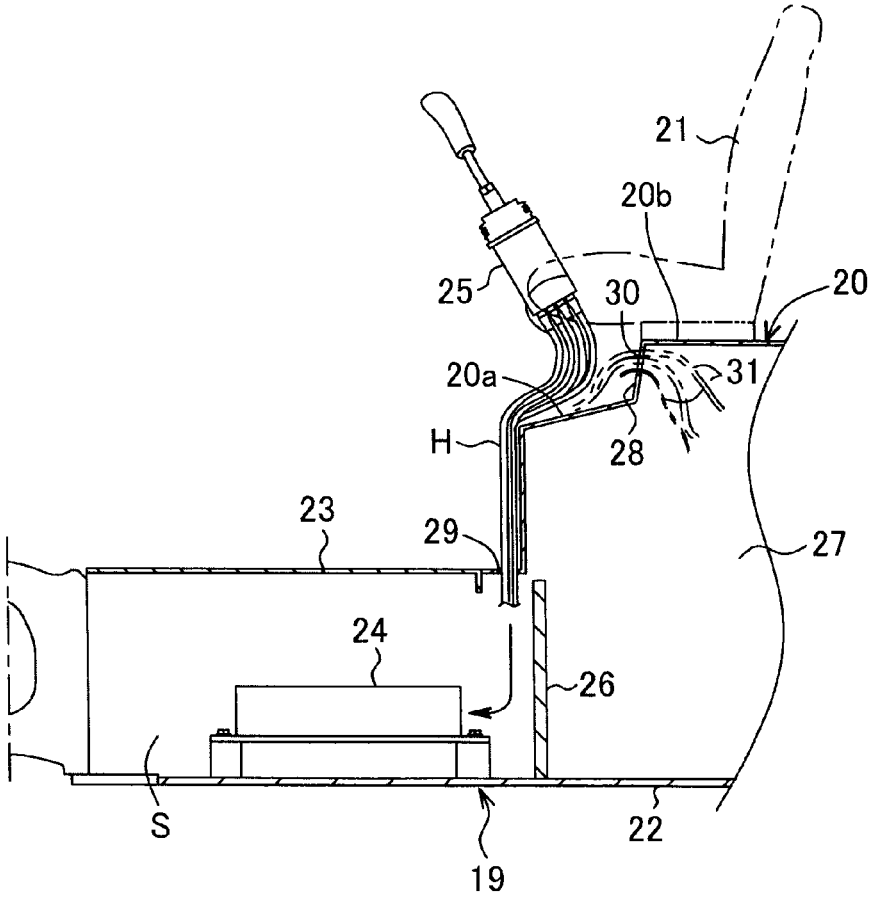
FIG. 2 is an enlarged sectional view taken along the line II-II in FIG. 1.

As shown in FIGS. 2 and 3, the specific surface 20*a* according to the embodiment, namely, a lower-height surface, is inclined forward with a gentle angle, that is, so as to be lowered with close to the outside of the seat stand 20. Each pilot hose H is allowed to be routed so as to form just a gentle curve along the inclination of the specific surface 20*a* within the routing space S.

Figure 4:
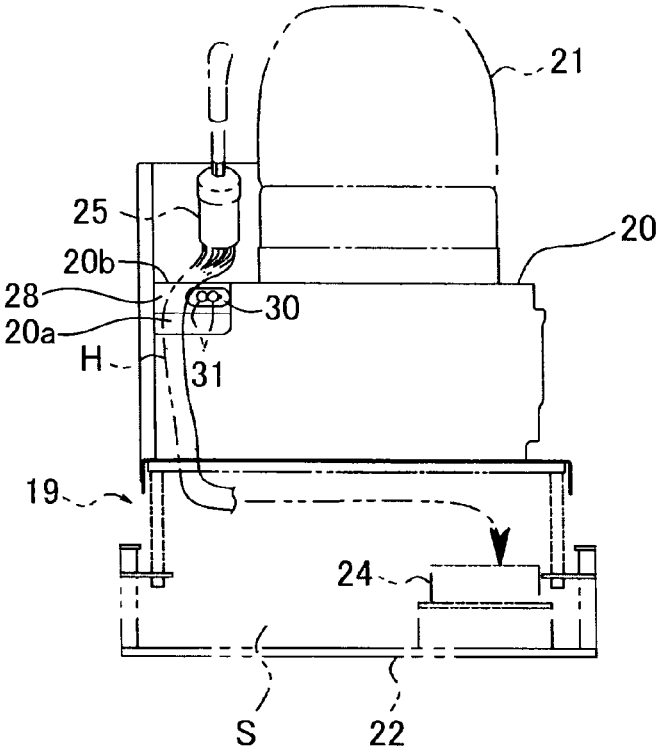
FIG. 4 is a front view of a seat stand according to the embodiment.
Figure 5:
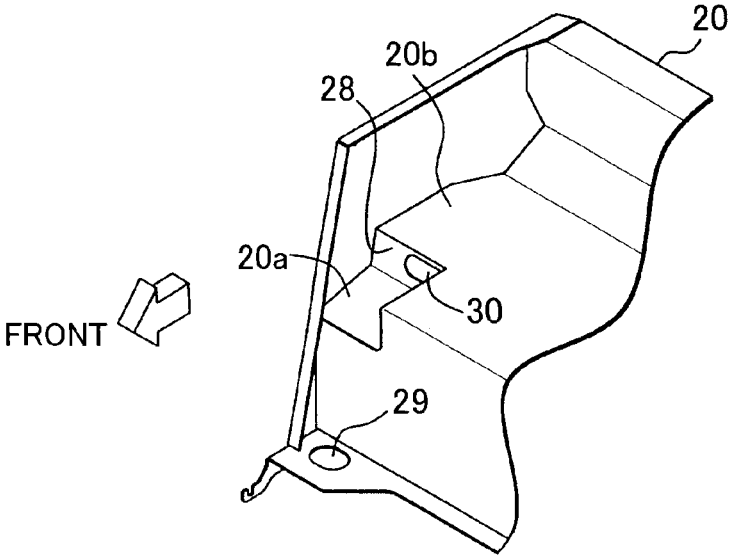
FIG. 5 is a perspective view of an important part of the seat stand.

The step wall 28 is provided with a through-hole 30, through which a cord-like member other than the pilot hoses H, such as an air conditioner hose to be used in a cabin type excavator or a wiring 31 shown in FIGS. 2 and 3, is routed. As shown in FIGS. 1, 4 and 5, the through-hole 30 is provided at a position offset leftward from a widthwise center of the step wall 28 so as to avoid interference with the pilot hoses H. The through-hole 30, while being indicated in FIGS. 1, 4 and 5 as a horizontally-long elongate hole, is permitted to have a shape freely modified. For example, the shape may be vertically long or circular. Besides, there may be a plurality of the through-holes 30 provided at respective different positions.

Figure 7:
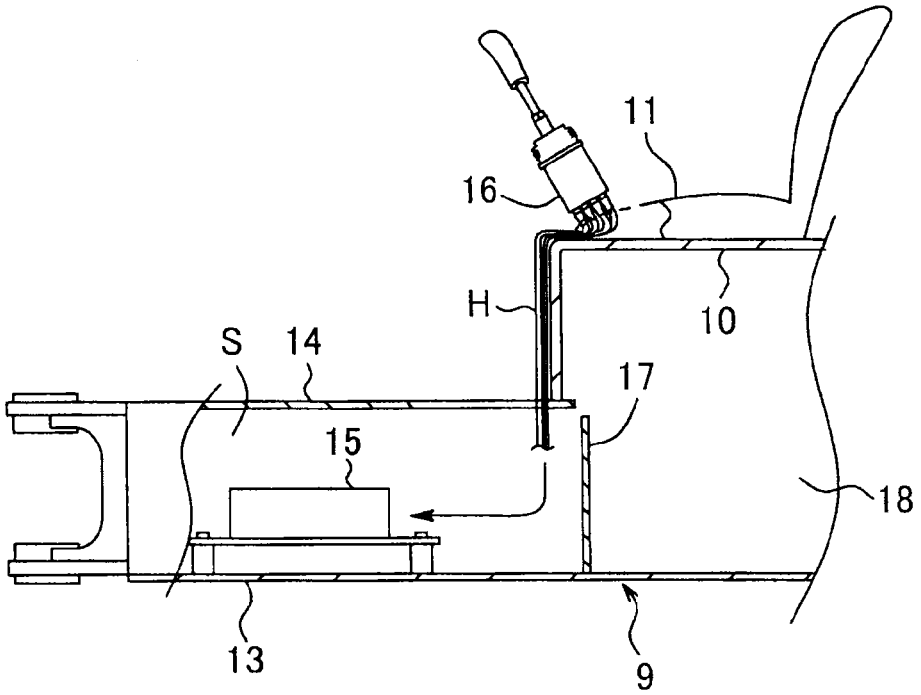
FIG. 7 Prior Art
FIG. 7 is a sectional side view of a structure for routing a pilot hose in a conventional excavator.

The step thus provided in the seat stand 20 makes it possible to form a space having a larger height than that of a space provided for routing of a pilot hose in a conventional construction machine, for example, a space between the lower surface of the remote control valve and the upper surface of the seat stand 10 shown in FIG. 7. In other words, the step enables a space usable for routing the pilot hoses H beneath the remote control valve 25 to be significantly heightwise enlarged by a vertical size of the step, thereby allowing the pilot hoses H to be easily routed in the course passing through the outside of the engine room 27, with just gentle and limited bending as shown. This enables simplified joining structure required for the routing, reduced component cost and high production efficiency by reduction in workload in an assembling line to be established.

As an alternative measure against the problem with routing of the pilot hoses H, it is conceivable to provide a routing hole in a top wall of the seat stand 20 and route the pilot hoses H so as to let the pilot hoses H extend downwardly into the engine room 27 through the routing hole and reach the control valve unit 24; this routing, however, involves various negative effects, for example, a possibility that a device within the engine room 27 hinders the routing, a necessity of a sealing structure for preventing leakage of heat and sound from the routing hole, a requirement for a sealing structure for preventing ignition from being caused by leakage of oil from the pilot hose H, and the like.

On contrary, the routing through the routing space C enlarged by the step, not requiring the pilot hoses H to pass inside the engine room 27, is not hindered by a device in the engine room 27, and requires no sealing structures for oil-ignition prevention, noise insulation or heat shielding. In addition, maintenance work for the pilot hoses H routed outside the engine room 27 can be performed easily. Furthermore, the enlargement of the routing space C by the provision of the step permits the seat stand 20 to maintain its high strength and rigidity.

Besides, routing the pilot hoses H in the course extending from the routing space C along the front surface of the seat stand 20 to the underfloor space S does not involve a problem of occupying a foot space for an operator seated in the operator's seat 21 or hindering manipulation and entering/exiting of the operator. In addition, routing the pilot hoses H along the front surface of the seat stand 20 allows a maintenance work for the pilot hoses H to be easily performed.

Moreover, the inclination of the specific surface 20*a*, i.e., such an inclination that the specific surface 20*a* is gradually lowered with close to the outside of the seat stand 20, allows the pilot hoses H to be routed along the inclination, with just a reasonable bending having a gently curved shape, thereby further facilitating the routing.

Besides, the through-hole 30 provided in the step wall 28 enables the routing space C enlarged by the step to be effectively utilized as a space for routing an additional cord-like member such as an air conditioner hose.

It should be understood that the present invention is not limited to the above embodiment but allowed to include, for example, the following embodiments.

(1) While the routing structure in the above embodiment is designed for the pilot hoses H to be connected to the right (inward) remote control valve 25, the present invention may also be implemented for a pilot hose to be connected to the left remote control valve. Besides, in the case where the plurality of remote control valves provided above the seat stand 20 include a remote control valve for controlling a dozer provided forward of the lower travelling body 1, the present invention may also be applied to routing of a pilot hose interconnecting the remote control valve for the dozer and a dozer control valve which is a hydraulic valve operated by the dozer remote control valve.

(2) While the specific surface 20*a* in the above embodiment is situated in the front end region of the upper surface of the seat stand 20 so as to allow the pilot hoses H to be led out forward of the seat stand 20, the present invention is not limited thereto: for example, in the case of leading out a pilot hose rightward or leftward of the seat stand, it is preferable to situate the specific surface in a right or left end portion of the seat stand.

(3) The present invention can be applied to not only a hydraulic excavator but any other construction machine, such as a dismantling machine or a crushing machine, which is constructed by diverting a hydraulic excavator and includes a remote control valve provided above a seat stand, a hydraulic valve operated by the remote control valve, and a pilot hose interconnecting the remote control valve and the hydraulic valve.

As described above, the present invention provides a construction machine including a hydraulic valve such as a control valve, a remote control valve, and a pilot hose interconnecting the hydraulic valve and the remote control valve, the construction machine allowing the pilot hose to be easily routed with a simple structure. Provided is a construction machine comprising: a lower travelling body; an upper slewing body including an upper frame and slewably mounted on the lower travelling body, the upper frame having a bottom plate and a floor plate provided above the bottom plate with a vertical interval; a seat stand located rearward of the floor plate and above the bottom plate of the upper frame; an operator's seat provided on the seat stand; a remote control valve provided just above a region of a front end portion of the seat stand, the region located at at least one of right and left sides of the operator's seat; a hydraulic valve configured to be operated by the remote control valve; and a pilot hose interconnecting the remote control valve and the hydraulic valve. The seat stand has an upper surface which includes a specific surface located beneath the remote control valve and a reference surface on which the operator's seat is provided, the upper surface of the seat stand being provided with a step between the specific surface and the reference surface so as to make the specific surface be lower than the reference surface and thus vertically enlarge routing space for routing the pilot hose beneath the remote control valve by the step.

The step, making the specific surface beneath the remote control valve be lower than the reference surface, enables a space for routing the pilot hose beneath the remote control valve to be enlarged, thereby allowing the pilot hose to be easily routed, with just gentle and limited bending and in the course passing the outside of an engine room. This enables simplifying joint structure for routing the pilot hose to thereby reduce component cost and reducing a workload in an assembling line to thereby enhance production efficiency to be achieved. In addition, differently from the case of routing the pilot hose inside an engine room, a device within the engine room cannot hinder the pilot hose from being routed, and there is no need for sealing structures for oil-ignition prevention, noise insulation and heat shielding. Furthermore, routing the pilot hose outside the engine room allows a maintenance work therefor to be easily performed. Besides, the enlargement of the routing space by the provision of the step in the seat stand allows the seat stand to maintain its high strength and rigidity.

As a specific embodiment, preferable is one where: the specific surface is situated in a front end region of the upper surface of the seat stand at a side opposite to an entrance way for the operator's seat; the hydraulic valve configured to be operated by the remote control valve provided just above the specific surface is installed in an underfloor space between the bottom plate and the floor plate; and the pilot hose is routed in a course extending from the routing space to the underfloor space along a front surface of the seat stand. The thus routed pilot hose cannot occupy a foot space for an operator seated in the operator's seat or hinder an operator from manipulation or entering/exiting. Besides, maintenance work for the pilot hose routed along the front surface of the seat stand is further facilitated.

The specific surface is, preferably, inclined toward an outside of the seat stand. The inclination of the specific surface allows the pilot hose to be routed while being bent just in a gently curved shape along the inclination of the specific surface, that is, reasonably bent, thereby further facilitating the routing.

It is preferable that the seat stand has a step wall between the specific surface and the reference surface, the step wall being provided with a through-hole which allows a cord-like member other than the pilot hose to be routed through the through-hole. The through-hole enables the routing space enlarged by on the step to be effectively utilized as a space for routing a cord-like member other than the pilot hose, such as an air conditioner hose to be installed in a cabin type excavator, or a wiring.

This application is based on Japanese Patent application No. 2013-224971 filed in Japan Patent Office on Oct. 30, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A construction machine comprising:

a lower travelling body;

an upper slewing body including an upper frame and slewably mounted on the lower travelling body, the upper frame having a bottom plate and a floor plate provided above the bottom plate with a vertical interval;

a seat stand located rearward of the floor plate and above the bottom plate of the upper frame;

an operator's seat provided on the seat stand;

a remote control valve provided just above a region of a front end portion of the seat stand, the region located at at least one of right and left sides of the operator's seat;

a hydraulic valve configured to be operated by the remote control valve; and a pilot hose interconnecting the remote control valve and the hydraulic valve, wherein the seat stand has an upper surface which includes a specific surface located beneath the remote control valve and a reference surface on which the operator's seat is provided, the upper surface of the seat stand being provided with a step between the specific surface and the reference surface so as to make the specific surface be lower than the reference surface and thus vertically enlarge routing space for routing the pilot hose beneath the remote control valve by the step.

2. The construction machine as defined in claim 1, wherein: the specific surface is situated in a front end region of the upper surface of the seat stand at a side opposite to an entrance way for the operator's seat; the hydraulic valve configured to be operated by the remote control valve provided just above the specific surface is installed in an underfloor space between the bottom plate and the floor plate; and the pilot hose is routed in a course extending from the routing space to the underfloor space along a front surface of the seat stand.

3. The construction machine as defined in claim 1, wherein the specific surface is inclined toward an outside of the seat stand.

4. The construction machine as defined in claim 1, wherein the seat stand has a step wall between the specific surface and the reference surface, the step wall being provided with a through-hole allowing a cord-like member other than the pilot hose to be routed through the through-hole.

* * * * *